United States Patent [19]

Cross

[11] Patent Number: 4,697,191

[45] Date of Patent: Sep. 29, 1987

[54] OMNIAZIMUTHAL ANTENNA

[75] Inventor: Marshall W. Cross, Stow, Mass.

[73] Assignee: Science Applications International Corporation, La Jolla, Calif.

[21] Appl. No.: 732,233

[22] Filed: May 8, 1985

[51] Int. Cl.[4] ..... H01Q 9/44; H01Q 1/40; H01Q 1/04

[52] U.S. Cl. ..... 343/809; 343/719; 343/873; 343/904

[58] Field of Search ..... 343/719, 905, 792–795, 343/809, 814, 816, 820, 826, 827, 865, 904, 859, 873; 333/24 R, 27

[56] References Cited

U.S. PATENT DOCUMENTS

| | | | |
|---|---|---|---|
| 1,220,005 | 3/1917 | Rogers et al. | 343/719 |
| 2,214,830 | 9/1940 | Carlson | 343/814 X |
| 2,258,406 | 10/1941 | Carter | 343/809 X |
| 2,382,217 | 8/1945 | Fancher | 333/24 R |
| 2,433,183 | 12/1947 | Wolf | 343/795 |

FOREIGN PATENT DOCUMENTS

| | | | |
|---|---|---|---|
| 833351 | 7/1943 | France | 343/795 |
| 2140215 | 11/1984 | United Kingdom | 343/719 |

*Primary Examiner*—Marvin L. Nussbaum
*Attorney, Agent, or Firm*—Bruno J. Verbeck

[57] ABSTRACT

Disclosed herein is an antenna of simplified and integral construction which comprises a pair of electrical conductors defining a pair of antenna elements or arms aligned in substantially mutually orthogonal longitudinal alignment along a substantially horizontal plane, the longitudinal dimension of the antenna elements corresponding to about one-half the in-medium wavelength of a preselected frequency. An electrically balanced transmission line is formed integral with the electrical conductors and establishes electrical communication between the antenna and a remote RF receiver/transmitter. The antenna has general applicability both as an above-ground antenna and as a buried antenna.

9 Claims, 3 Drawing Figures

OMNIAZIMUTHAL ANTENNA

DESCRIPTION

1. Technical Field

The present invention relates in general to antennas, and in particular to omniazimuthal dipole antennas.

2. Background Art

Dipole antennas consisting of mutually orthogonal dipoles coplanarly supported in a horizontal plane have been employed for quite some time in situations requiring substantially omniazimuthal coverage, both as above-ground antennas and as buried antennas.

More particularly, N. Wells, "The Quadrant Aerial: An Omni-Directional Wide-Band Horizontal Aerial for Short Waves", IEE, 1944, Pp. 182–193, discloses an end-fed dipole antenna comprising a pair of mutually orthogonal, half wavelength dipoles supported above ground in a horizontal plane and connected to a radio receiver/transmitter via a section of balanced transmission line. Wells teaches that substantially omniazimuthal coverage can be achieved by end feeding the dipoles with electrical signals that are in antiphase, i.e.—180° out of phase, relationship.

Leydorf et al, U.S. Pat. No. 3,594,798, discloses a buried antenna comprising quarter wavelength dipoles longitudinally aligned in pairs to form effectively a center fed half wavelength dipole. A second pair of substantially identical quarter wavelength dipoles are arranged in substantially mutual orthogonal alignment with the first pair, and the two pairs are positioned and buried below ground level in a substantially horizontal plane. Each dipole pair produces a "figure eight" pattern which, when superimposed with the pattern produced by the other pair, results in substantial omniazimuthal coverage for the antenna.

Hitherto, antennas have been formed from a plurality of discrete elements, namely the antenna arms themselves and the transmission lines electrically connecting the antenna arms to a radio receiver/transmitter situated at some remote location. The use of such discrete elements has necessitated, at least in antennas of the type exemplified by Wells, the inclusion of junction boxes and various electrical connectors between the various antenna elements. Construction difficulties are further compounded with antennas as exemplified by Ladorf et al. since phasing lines and/or phasing networks are required in order to achieve phase quadrature, i.e.—a 90° face shift, between the signals being center fed to the mutually orthogonal dipole pairs.

The need for junction boxes, electrical connections, phasing lines, phasing networks, etc., in addition to complicating antenna construction and increasing construction costs, represent yet another antenna element which may fail at an inappropriate time. It would, therefore, be highly desirable and beneficial to provide an antenna capable of achieving omniazimuthal coverage, and yet being of such simple construction that the likelihood of its failure is almost virtually nil.

DISCLOSURE OF THE INVENTION

In view of the foregoing, it is an object of the present invention to provide an omniazimuthal antenna which is of extremely simple construction and, therefore, less prone to failure.

Another object of the present invention is to provide an omniazimuthal antenna wherein the dipole elements and the transmission line connecting the dipole elements to the radio receiver/transmitter are of integral construction, thereby eliminating the need for the various antenna components hitherto required.

A still further object of the present invention is to provide an omniazimuthal antenna of simplified construction which may be deployed either above or below ground.

Yet another object of the present invention is to provide an omniazimuthal antenna satisfying each of the above-stated general objects which can be formed from readily available and conventional electrical transmission lines.

In accordance with the disclosure herein, an omniazimuthal antenna may be constructed from either a single section of conventional shielded twin axial cable or a pair of conventional shielded coaxial cables. In the twin axial case, one end of the twin axial cable is stripped of its shield and outermost protective sheath a distance corresponding to one-half the wavelength of a preselected frequency in the medium in which the antenna elements or arms will be positioned. The cable's two internal electrical conductors and their respective dielectric covers are then split apart and coplanarly supported in a horizontal plane in substantially mutually orthogonal longitudinal alignment. This results in an end fed, half wavelength, omniazimuthal dipole antenna having a balanced transmission line integrally formed therewith.

Alternatively, a pair of twin axial cables can be likewise stripped to expose their electrical conductors and dielectric covers. The non-stripped portion of each coaxial cable is supported in relatively closely spaced relationship with the other cable so that the non-stripped portions together serve as a balanced transmission line connected to the antenna elements.

A conventional balun, or the like, may be attached to the opposite end(s) of the cable(s) to electrically couple the antenna to a radio receiver/transmitter if a balanced-to-unbalanced condition exists between the balanced transmission line and the radio receiver/transmitter.

In the case of a buried antenna, at least the antenna elements may be buried in the ground at a depth sufficient to ensure that the antenna is protected from all reasonably likely source of damage thereto.

BRIEF DESCRIPTION OF THE DRAWINGS

The above-mentioned and other objects and features of this invention, and the manner of obtaining them, will be apparent, and the invention itself will be best understood, by reference to the following descriptions of the invention taken in conjunction with the accompanying drawings, wherein.

BEST MODE FOR CARRYING OUT THE INVENTION

Figure 1:
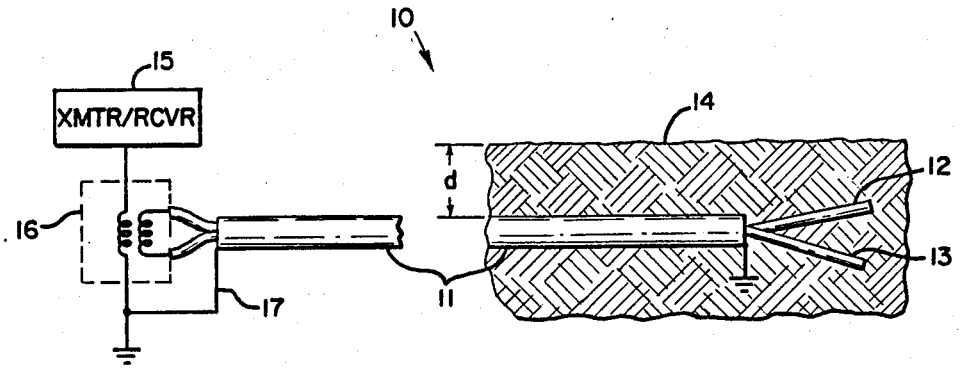
FIG. 1 illustrates a radio communications system employing an antenna and transmission line therefor, constructed in accordance with the practice of the invention.

Referring now to the drawings, and in particular to FIG. 1, a radio communication system 10 is illustrated which employs an antenna according to this invention.

The antenna comprises a balanced transmission line 11, having a pair of antenna arms or elements 12 and 13 extending outwardly from one end thereof. Antenna elements 12 and 13 are coplanarly aligned along a substantially horizontal plane in substantially mutual orthogonal longitudinal alignment. While the antenna of this invention has general applicability as both an above-ground antenna and as a buried antenna, it is presently contemplated that it will find its primary utility as a buried antenna. Accordingly, at least antenna elements 12 and 13 are buried in the ground 14 at a preselected depth, which is determined by both the propagation characteristics of RF signals through the ground and the various environmental influences from which the antenna must be protected, including the need to avoid damage in the event of an attack on the antenna site by hostile forces. The various parameters which must be considered in arriving at a determination of an appropriate burial depth are well-known and understood and, therefore, necessarily involves a balancing of competing interests between RF propagation efficiency and the need for antenna protection. In most situations, it is expected that a burial depth of about 1 meter will be entirely satisfactory.

At its opposite end balanced transmission line 11 is electrically coupled to an RF transmitter/receiver 15. In the situation where RF transmitter/receiver 15 has a balanced input/output, balanced transmission line 11 may be directly connected thereto. Otherwise, balanced transmission line 11 is coupled to RF transmitter/ receiver 15 through a conventional balun transformer 16 which compensates for balanced-to-unbalanced conditions.

Figure 2:
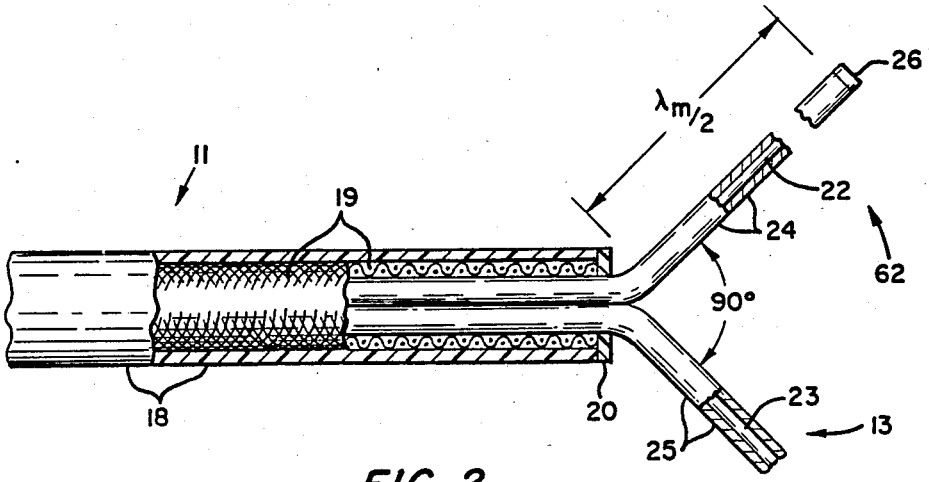
FIG. 2, is a partial plan view of the preferred embodiment of the present invention.

Referring to FIG. 2, an antenna according to the preferred practice of this invention, is formed from conventional twin axial cable having an outer protective sheath 18, a shield 19 of braided wire, and a pair of electrical conductors 22 and 23 encased respectively, within dielectric sheaths 24 and 25. The antenna is formed by stripping sheath 18 and shield 19 from one end of the cable a distance corresponding to about one-half the wavelength of a preselected frequency in the medium in which the antenna is positioned. In this manner a pair of end fed half wavelength (in medium) antenna elements 12 and 13 are formed which are then physically moved apart to establish substantially mutually orthogonal longitudinal alignment therebetween. The exposed ends of the cable are provided with protective end caps 20 and 26 formed from dielectric material such as room temperature vulcanizing (RTV) sealant.

Turning back to FIG. 1, the shield 19 of balanced transmission lines 11 is connected through line 17 to the balun transformer 16 ground. Optionally, the shield 19 may also be grounded at its opposite end in the soil supporting antenna elements 12 and 13.

An important feature of this invention which should be readily apparent from even a casual review of FIG. 2, is that the balanced transmission line 11 and antenna elemcnts 12 and 13 are integrally formed from a single section of twin axial cable. As a consequence, it is now possible to construct an especially simple and highly reliable antenna which eliminates the need for junction boxes, electrical connectors, phasing lines, phasing networks, etc., as hitherto required by the prior art.

Figure 3:
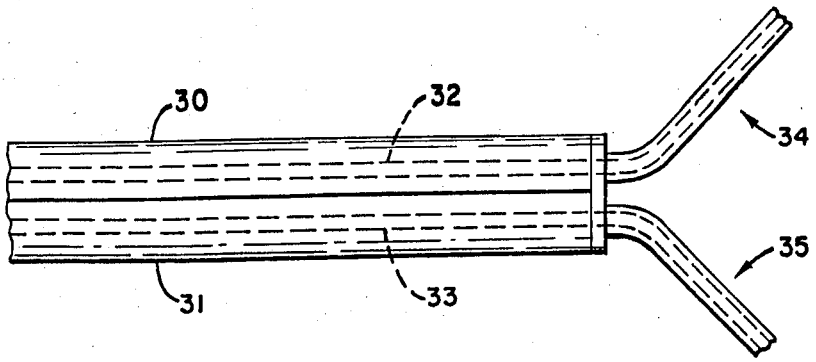
FIG. 3 is a partial plan view of an alternate embodiment of the present invention.

Referring to FIG. 3, therein is illustrated an alternate embodiment of the present invention wherein the antenna is formed from a pair of conventional coaxial cables 30 and 31 having electrical conductors 32 and 33, respectively, axially extending therethrough. As with the antenna of the preferred embodiment shown in FIG. 2, coaxial cables 30 and 31 are each stripped of their outer protective sheaths and shields to form antenna elements 34 and 35. In the unbalanced-to-balanced situation shown in FIG. 1, the shields of cables 30 and 31 should be electrically interconnected at the ends thereof proximate the RF transmitter/receiver 15, and then connected to the balun transformer 16 ground via line 17. While not shown, it will be also understood that the cable shields at the opposite ends of cables 30 and 31 may optionally likewise be electrically interconnected and grounded to the soil supporting antenna elements 34 and 35. It should be noted that cables 30 and 31 do not individually comprise a balanced transmission line, and therefore, it is necessary that the cables be supported in relatively close proximity to one another along their longitudinal dimensions so that together they comprise a balanced transmission line.

As a particularized example of an antenna constructed in accordance with the preferred embodiment disclosed herein, an antenna optimized for the frequency 50 MHz may be constructed from 95 ohm dual-tube-shielded twin axial transmission line by stripping from one end thereof approximately 1.5 meters of the outer protective sheath and braided wire shield. The twin electrical conductors and their respective dielectric sheaths thus exposed are pulled apart 90°, aligned in a horizontal plane, and then buried in the ground at a burial depth of about 1 meter. The length of the balanced transmission line is somewhat arbitrary and depends upon both power losses in the transmission line and the distance between the RF transmitter/receiver and the antenna elements. For reasons of covertness, it is preferred that the transmission line also be buried in the ground to the maximum extent practicable.

In view of the foregoing it will be understood that disclosed herein is an invention which embraces each of the general objects therefor earlier stated. While the invention is disclosed herein with reference to a preferred and alternate form thereof, it will be understood that various changes, rearrangements, and modifications can be made thereto without departing from the essence and scope of the invention as defined in the appended claims. Therefore, it is intended that the present disclosure not be interpreted in a limiting sense and that obvious variants of the invention are comprehended to be within its essence and scope.

I claim:

1. An antennna adapted for burial, comprising:

(a) a pair of antenna elements aligned along a substantially horizontal plane in substantially mutually orthogonal longitudinal alignment;

(b) the longitudinal dimension of said antenna elements corresponding to about ½ the in-medium wavelength of a preselected frequency; and (c) electrically balanced, shielded, transmission line means comprising a pair of dielectrically insulated conductors for establishing electrical communication between said antenna elements and an RF receiver/transmitter;

(d) said antenna elements being unshielded, integral, dielectrically insulated end-portions of said conductors, and extending beyond the shielding of said transmission line means.

2. The antenna of claim 1 wherein said transmission line means is selected from the group consisting of a pair of coaxial cables, and twin axial cable.

3. An antenna as set forth in claim 2 wherein at least said antenna elements are buried in the ground at a preselected depth.

4. The antenna of claim 2 wherein a balun is secured to the opposite end, or ends of said cable, or cables, to electrically coupled the antenna to an RF receiver/-transmitter.

5. A buried-in-soil antenna comprising:

(a) a pair of antenna elements aligned along a substantially horizontal plane insubstantially mutually orthogonal alignment;

(b) the longitudinal dimension of said antenna elements corresponding to about ½ the in-medium wavelength of a preselected frequency;

(c) transmission line means in the form of a twin axial cable having an outer protective sheath and braided wire shield surrounding two conductors eaeh of which is surrounded by dielectric insulator material, for establishing electrical communication between said antenna elements and an RF receiver/transmitter;

(d) said antenna elements being unshielded, integral, dielectrically insulated end-portions of said conductors.

6. The antenna of claim 5 wherein the transmission line means is in the form of a pair of sheathed, shielded, coaxial cables.

7. The antenna of claim 5 wherein the shield of said balanced transmission line means is connected to a balun transformer ground.

8. The antenna of claim 7 wherein said shield is also grounded in said soil contacting said antenna elements.

9. The antenna of claim 5 or 6 wherein the shields of said cables are electrically interconnected at the ends thereof proximate an RF transmitter/receiver and also to a balum transformer.

* * * * *